US006663048B2

(12) United States Patent
Weelden et al.

(10) Patent No.: US 6,663,048 B2
(45) Date of Patent: Dec. 16, 2003

(54) MOUNTING STRUCTURE FOR ATTACHING A PAYLOAD, SUCH AS A WARHEAD, TO MUNITIONS

(75) Inventors: Scott Van Weelden, Lancaster, CA (US); Steve Ericson, Lancaster, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 3 days.

(21) Appl. No.: 10/047,410

(22) Filed: Jan. 16, 2002

(65) Prior Publication Data

US 2003/0131748 A1 Jul. 17, 2003

(51) Int. Cl.[7] ..... B64D 1/12
(52) U.S. Cl. ..... 244/137.4
(58) Field of Search ..... 244/137.4; 89/1.53, 89/1.54, 1.56, 1.58; 102/293

(56) References Cited

U.S. PATENT DOCUMENTS 3,942,749 A * 3/1976 Hasquenoph et al. .... 244/137.4
4,031,805 A * 6/1977 Puttinger et al. ..... 89/1.58
4,347,777 A * 9/1982 Jakubowski, Jr. et al. ... 89/1.58
5,231,928 A * 8/1993 Phillips et al. ..... 102/351
5,487,322 A * 1/1996 Rhodes ..... 89/1.56
5,520,476 A * 5/1996 Marks et al. ..... 403/322.3
5,961,075 A * 10/1999 Russell, III ..... 244/137.4
5,970,842 A * 10/1999 Knapp et al. ..... 89/1.54
6,203,237 B1 * 3/2001 Swift et al. ..... 403/322.3

* cited by examiner

*Primary Examiner*—Peter A. Nelson

(57) ABSTRACT

The invention entails apparatus for mounting a payload, such as a warhead, to bulkheads carried by munitions. The apparatus comprises fore and aft bulkheads depending from the munitions, each of the bulkheads having a substantially centrally located opening; bulkhead attaching structure carried by the payload and engaging at least one of the bulkheads, and at least one fastener carried by the bulkhead attaching structure and engaging both the payload and the bulkhead attaching structure. In one embodiment, the bulkhead attaching structure is an annular ring element disposed about and secured to the aft end of said payload. The ring element includes a first annular portion of a first diameter, and a second aft portion of a second diameter, the first diameter of said first portion being smaller than the second diameter to accommodate annular portions of the aft bulkhead. In a second embodiment, the bulkhead attaching structure comprises a step element carried by the payload, which abuts the fore bulkhead. The step element may be integral with the payload or a separate discrete element. In a third embodiment, the bulkhead attaching structure comprises a vertical buttress carried by the aft bulkhead and a tension element for fastening the vertical buttress to the aft end of the payload.

11 Claims, 3 Drawing Sheets

MOUNTING STRUCTURE FOR ATTACHING A PAYLOAD, SUCH AS A WARHEAD, TO MUNITIONS

BACKGROUND OF THE INVENTION

1. Field of the Invention

The present invention relates to munitions-bearing warheads, and more particularly to mounting structures for securing payloads, such as warheads, to munitions structures.

2. Description of the Related Art

The mounting of warheads to munition structures is analogous in some regards to the mounting of stores and fuel tanks to aircraft structures. In both cases, it is desirable to provide an attachment which can easily be broken, whether through external means, such as by way of a mechanical release mechanism or an explosive connection, or through shearing of an attachment device using the kinetic energy associated with the structure. For example, U.S. Pat. No. 6,203,237 to Swift et al discloses an expandable and retractable collet for releasably connecting first and second structures together, while U.S. Pat. No. 5,520,476 to Marks et al discloses an explosively actuated device.

Most munitions used today contain an explosive payload or warhead, and the function of the munition is to mount and integrate the warheads to sustain the loading environment encountered by the munition during its mission.

In the case of penetrating warheads, the mission ordinarily might include impacting structures, such as bunkers, which possess thick concrete walls and often are covered with dirt and other detritus. To successfully engage the target, penetration depth must be maximized.

One method of increasing penetration depth is to increase the momentum of the warhead at impact. Tying the mass of the munition itself into the warhead in some fashion would accomplish this, but it is difficult to provide structure that will support all "normal" loads, then provide a strong "push" to the warhead on impact, and finally release the warhead so it can continue on through the target. If the warhead is not released, then the entire mass of the munitions would have to be dragged through the target, dissipating energy and decreasing penetration depth.

There is therefore a long felt need for release apparatus which allows mounting of a warhead on a munition, but which also facilitates separation of the warhead from the munitions upon impact with the target, so that the warhead can move forward through the target maximizing penetration depth of the warhead into the target.

The present invention provides a solution to this long felt need.

SUMMARY OF THE INVENTION

In one aspect of the present invention, an apparatus for mounting a warhead t a munition includes a cylindrical boost ring having spaced apart radially outwardly directed flanges and a radially inwardly directed flange. The outwardly directed flanges engage and therefore securely mount the boost ring to the bulkhead, while the radially inwardly directed flange is secured to the aft portion of the warhead with a shear pin, which provides load transfer to the warhead from the munitions.

In another aspect of the invention, an apparatus for mounting a warhead to a munitions includes a transfer flange having an aft radially outwardly directed flange in abutment with the forward side of the forward bulkhead, and a shear pin located just aft of a rearward bulkhead engages the rearward bulkhead and is secured to the aft portion of the warhead.

In yet another aspect of the invention, an apparatus for mounting a warhead to munitions includes a conical boost ring having spaced apart radially outwardly directed flanges and a radially inwardly directed flange. The two outwardly directed flanges engage and therefore securely mount the boost ring to the bulkhead, while the radially inwardly directed flange is secured to the aft portion of the warhead with a shear pin which provides a one-way load transfer to the warhead from the munitions.

These and other aspects, advantages and features of the invention will become more apparent, as will equivalent structures, which are intended to be covered herein, with the teaching of the principles of the invention in connection with the disclosure of the preferred embodiments thereof in the specification, claims and drawings in which:

DETAILED DESCRIPTION OF THE INVENTION

The following description is provided to enable any person skilled in the art to make and use the invention and sets forth the best modes contemplated by the inventor of carrying out this invention. Various modifications, however, will remain readily apparent to those skilled in the art, since the generic principles of the present invention have been defined herein specifically to provide an apparatus for securing a warhead to the bulkhead structures associated with munitions.

Figure 1:
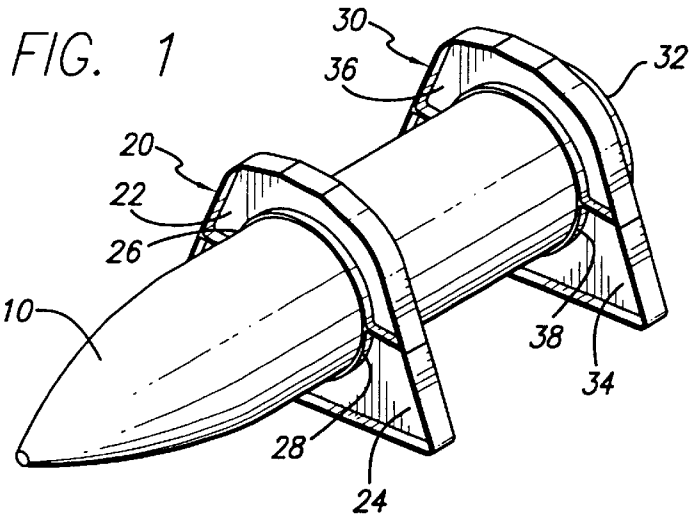
FIG. 1 shows generally, in perspective view, a warhead and bulkheads, which are relied upon to secure the warhead to munition.

Referring now to FIG. 1 of the drawing, there is shown a warhead 10 about which are secured a forward bulkhead 20 and an aft bulkhead 30, both of which are secured to a munition structure (not shown). Preferably, the forward and aft bulkheads are of two-piece construction, having a top portion 22, 32 and a bottom portion 24, 34 (it is noted that the shape of the bulkheads are design choices, and a controlling factor determining the ultimate shape or configuration of the bulkheads is a function of the space requirements where the warheads will be secured) Cutouts 26, 36 and 28, 38 are provided in both the top portions and the bottom portions of the forward and aft bulkheads, respectively. Each of the pairs of cutouts in the respective bulkheads have curvilinear surfaces which are configured for close, intimate, contact with the upper and lower exterior surfaces of the warhead.

Figure 2:
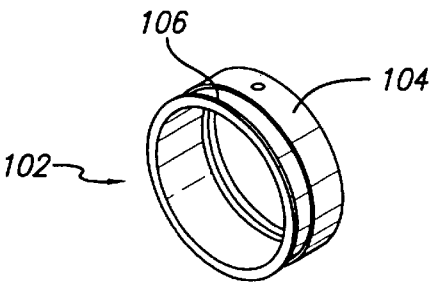
FIG. 2 is a cross-sectional view of a first embodiment of apparatus for securing a warhead to munition according to the teaching of the present invention.
Figure 3:
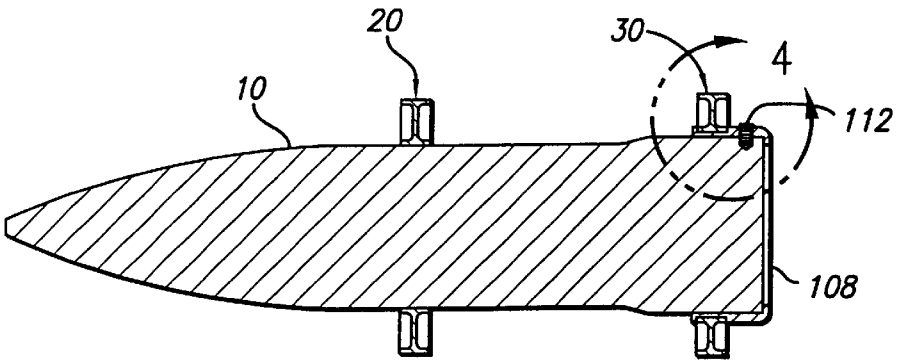
FIG. 3 is a cross-sectional view of a boost ring used in the structure of FIG. 2.
Figure 4:
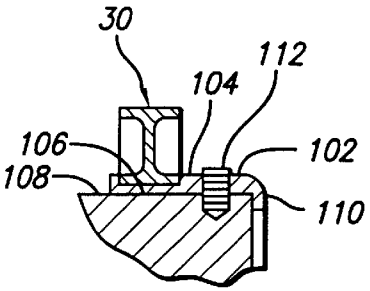
FIG. 4 is an enlarged sectional view of the structure shown at "4" in FIG. 2.
Figure 5:
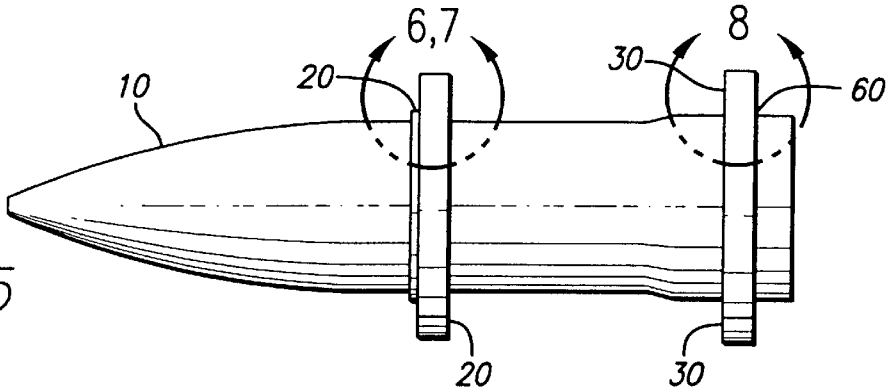
FIG. 5 is a cross-sectional view of a second embodiment of apparatus for securing a warhead to munition according to the teachings of the present invention.

FIGS. 2–4 show a first embodiment of the warhead mounting structure according to the teachings of the present invention in which the warhead includes a cylindrical boost ring 102 having a first axial portion 104 with an annular surface of a first diameter, and a second axial portion 106 with an annular surface of a second diameter smaller than the first diameter, the second axial portion being located axially forward of the first axial portion. The first and second annular portions are spaced apart axially along the axial length of the ring. An annular segment 108 at the forward end of the ring possesses a diameter at least as great as the first axial portion 104. A radially inwardly directed flange 110 is located at the rear end of the warhead, and is either continuous from side to side of the warhead or of limited annular extent so that a portion of the rear end of the warhead is not covered. The annular segment 108 engages and therefore securely mounts the boost ring 102 to the bulkhead, while the radially inwardly directed flange 110 is secured to the aft portion of the warhead with a shear pin or key 112 which provides load transfer to the warhead from the munitions.

Figure 8:
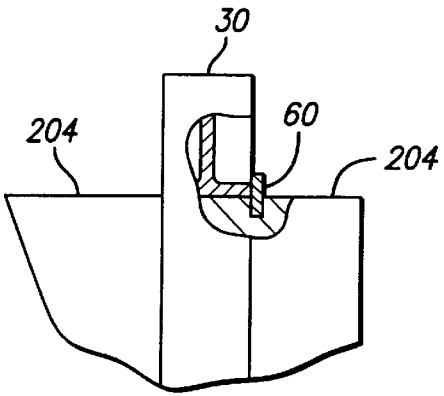
FIG. 8 is an enlarged sectional view of the structure shown at "8" in FIG. 5.
Figure 7:
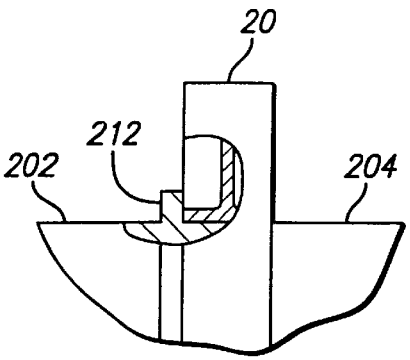
FIG. 7 is an enlarged sectional view of the structure shown at "7" in FIG. 5.
Figure 6:
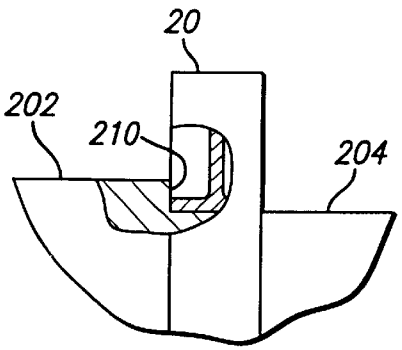
FIG. 6 is an enlarged sectional view of the structure shown at "6" in FIG. 5.

FIGS. 5–8 illustrate a second embodiment of the warhead mounting structure according to the teachings of the present invention, in which the forward and rearward bulkheads 20, 30 are secured to the warhead casing 10 in the manner shown in FIGS. 6–8. FIGS. 6 and 7 show interacting structure on the warhead casing 10 and the forward bulkhead 20, while FIG. 8 shows interacting structure on the rearward bulkhead 30 and the warhead casing 10.

The structure depicted in FIGS. 6 and 7 constitutes a transfer flange, which is provided for the purpose of transferring the momentum of the munitions structure to the warhead after the munitions structure strikes the target.

Referring first to FIG. 6, the warhead casing is preferably formed with first and second diameters 202, 204 located in the vicinity of the position at which the forward bulkhead 20 supports the warhead. The first diameter 202 is larger than the second diameter 204, and meets the second diameter just forwardly of the forward bulkhead 20 forming with the first diameter a "step" 210 such that the forward surface of the bulkhead 20 engages the rearwardly facing surface of the step. In FIG. 7, the forward bulkhead 20 is seen to be engaged with a short axially extensive flange portion 212 formed on the warhead casing (or it may be formed as a discrete element encircling the warhead casing) just forwardly of the bulkhead 20.

FIG. 8 shows the rearward bulkhead 30 is secured about the rear portion of the warhead casing 10, and secured there via a set screw or shear pin 60 which may be threaded or otherwise securedly engaged in an opening in the warhead casing adapted to receive the screw or shear pin 60. Preferably, the screw or shear pin 60 has a head that sits atop the outer surface of the warhead casing and also butts up against the rearward surface of the rear bulkhead 30 to thereby hold the latter securely in place until the fracture of the screw or pin 60. Normal environmental loads will ordinarily be reacted through the screw or shear pin into the munitions structure. On impact of the warhead into the target, the forward munitions structural interface will impart the momentum of the munitions to the warhead via the transfer flange. The shear pin or screw is sized solely for reacting normal environmental loads, and thus will fracture or shear upon impact, thereby allowing the warhead to exit the structure without undue loss of energy.

Figure 9:
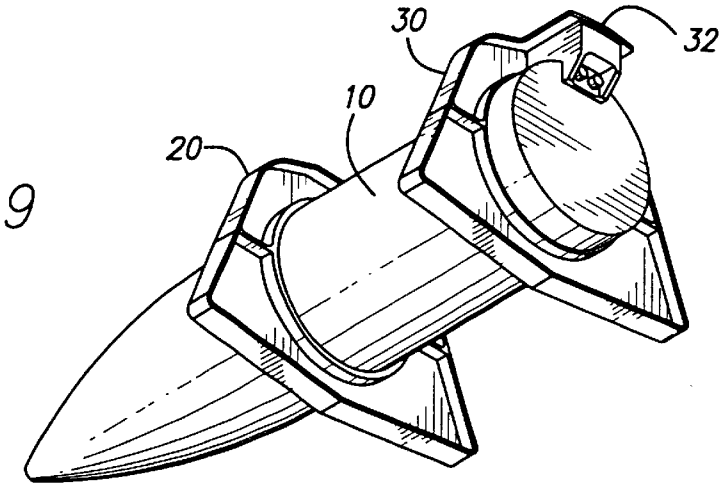
FIG. 9 is a perspective view of a third embodiment of apparatus for securing a warhead to munitions according to the teachings of the present invention.
Figure 10:
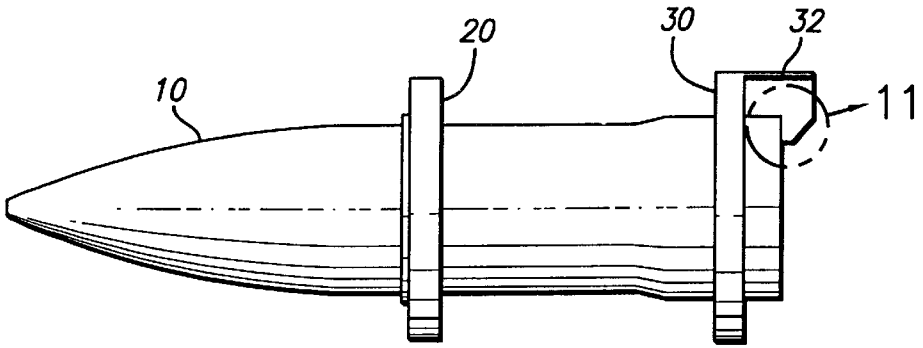
FIG. 10 is a side view of the warhead to munition mounting apparatus shown in FIG. 9.
Figure 11:
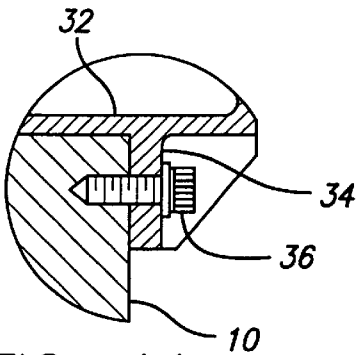
FIG. 11 is an enlarged cross-sectional view of the structure shown within the circle denoted with the numeral "11" shown in FIG. 10.

FIGS. 9–11 depict a third embodiment of the warhead mounting structure according to the teachings of the present invention. In these Figures, it can be seen that the rearward bulkhead 30 is provided with a rearwardly extending support portion 32 that possesses a vertical buttress 34 adapted for engagement with the rear end of the warhead casing 10. Referring to FIG. 11, it can be seen that the vertical buttress 34 closely engages the rear face of the warhead casing, and a tension fastener 36, such as a threaded fastener or a key element, is provided to secure the support portion of the rearward bulkhead 30 to the warhead casing through an opening formed in the buttress and into engagement with the rear portion of the warhead casing.

The mounting arrangement shown in FIGS. 9–11 allows the bulkhead structure to directly contact the warhead, rather than having some finite gap dependent on the manufacturing tolerances of the interfacing hardware. Further, this arrangement permits normal environmental loads to be reacted through the fastener(s) into the warhead/warhead structure. On impact of the warhead into the target, the vertical buttress 34 imparts the momentum of the warhead to the warhead. The fastener(s), sized solely for reacting normal environmental loads, will fracture thus allowing the warhead to exit the structure without undue loss of energy.

Those skilled in the art will appreciate that various adoptions and modifications of the invention as described above can be configured without departing from the scope and spirit of the invention. Therefore, it is to be understood that, within the scope of the appended claims, the invention may be practiced other than as specifically described herein.

We claim:

1. Apparatus for mounting a payload to bulkhead structure carried by munitions, said apparatus comprising:

fore and aft bulkheads depending from the munitions, each of the bulkheads having a substantially centrally located opening, bulkhead attaching structure carried by the payload and engaging at least one of the bulkheads, and at least one fastener carried by said bulkhead attaching structure and engaging both said payload and said bulkhead attaching structure.

2. The apparatus of claim 1, wherein said bulkhead attaching structure is an annular structure.

3. The apparatus of claim 1, wherein said annular structure includes a ring element disposed about and secured to the aft end of said payload.

4. The apparatus of claim 3, wherein said ring element includes a first annular portion of a first diameter, and a second aft portion of a second diameter, the first diameter of said first portion being smaller than the second diameter to accommodate annular portions of the aft bulkhead.

5. The apparatus of claim 1, wherein said annular structure comprises a radially larger portion of said payload.

6. The apparatus of claim 1, wherein said bulkhead attaching structure comprises a step element carried by said payload.

7. The apparatus of claim 6, wherein said step element is integral with said payload and comprises a vertical wall defined at the intersection of a first annular outer surface of said payload having a first diameter and a second annular outer surface of said payload having a smaller diameter.

8. The apparatus of claim 7, where in said step element abuts the first bulkhead.

9. The apparatus of claim 6, wherein said step element comprises a discrete annular element formed on the outer surface of said payload, the diameter of said annular element being greater than the diameter of said payload.

10. The apparatus of claim 9, wherein said annular element abuts the first bulkhead.

11. The apparatus of claim 1, wherein said bulkhead attaching structure comprises a vertical buttress depending from said aft bulkhead, and further comprising a tension member adapted to secure said vertical buttress to said payload.

* * * * *